US007150366B1

(12) United States Patent
Zakula, Sr. et al.

(10) Patent No.: US 7,150,366 B1
(45) Date of Patent: Dec. 19, 2006

(54) HANGER CHAIN ANTI-SWAY DEVICE FOR GANTRY CRANE

(75) Inventors: Daniel Brian Zakula, Sr., Mokena, IL (US); Eric Brian Van Gorp, Schererville, IN (US); Myron Glickman, Arlington Heights, IL (US)

(73) Assignee: Mi-Jack Products, Inc., Hazel Crest, IL (US)

( * ) Notice: Subject to any disclaimer, the term of this patent is extended or adjusted under 35 U.S.C. 154(b) by 190 days.

(21) Appl. No.: 10/902,343

(22) Filed: Jul. 29, 2004

(51) Int. Cl.
*B66C 17/20* (2006.01)

(52) U.S. Cl. ..... 212/272; 212/319; 212/344

(58) Field of Classification Search ..... 212/272–274, 212/319, 344; 294/81.3, 81.4
See application file for complete search history.

(56) References Cited

U.S. PATENT DOCUMENTS

| | | | | |
|---|---|---|---|---|
| 2,576,345 | A * | 11/1951 | Jacob | 414/459 |
| 2,796,183 | A * | 6/1957 | Cline et al. | 414/563 |
| 3,534,995 | A * | 10/1970 | Heikkinen | 294/119.4 |
| 3,653,518 | A * | 4/1972 | Polen | 212/330 |
| 3,698,581 | A * | 10/1972 | Goyarts | 414/460 |
| 3,764,032 | A * | 10/1973 | Ward | 414/608 |
| 3,789,998 | A | 2/1974 | Fathauer et al. | |
| 3,944,272 | A * | 3/1976 | Fathauer | 294/81.21 |
| 4,273,242 | A * | 6/1981 | Schaper | 212/273 |
| 4,563,030 | A | 1/1986 | Makino | |
| 4,715,762 | A * | 12/1987 | Lanigan et al. | 414/798.1 |
| 5,018,631 | A | 5/1991 | Reimer | |
| 5,022,543 | A | 6/1991 | Versteeg | |
| 5,048,703 | A | 9/1991 | Tax et al. | |
| 5,314,262 | A | 5/1994 | Meisinger et al. | |
| 5,526,946 | A | 6/1996 | Overton | |
| 5,715,958 | A | 2/1998 | Feider et al. | |
| 5,769,250 | A | 6/1998 | Jussila et al. | |
| 6,021,911 | A | 2/2000 | Glickman et al. | |

FOREIGN PATENT DOCUMENTS

| | | | |
|---|---|---|---|
| DE | 37 27 329 | A1 | 3/1989 |
| GB | 1 542 821 | A | 3/1979 |
| JP | 58-82986 | A | 5/1983 |
| JP | 2-132095 | A | 5/1990 |
| SU | 567658 | T | 9/1977 |
| WO | WO 98/34127 | A1 | 8/1998 |

* cited by examiner

*Primary Examiner*—Thomas J. Brahan
(74) *Attorney, Agent, or Firm*—Gardner Carton & Douglas LLP

(57) ABSTRACT

A sway dampener is provided for reducing sway motion of a gantry crane spreader that is suspended from hanger chains. The sway dampener is configured to resist motion of the hanger chain relative to the spreader, thereby retarding sway. The dampener includes first and second portions that are movable relative to each other in a resistive fashion, for example a piston-cylinder structure. The first portion is mounted to the spreader and the second portion is mounted to the hanger chain at an attachment point located a vertical distance above a point at which the hanger chain is pivotally mounted to the spreader so that horizontal sway motion of the attachment point relative to the spreader displaces the first and second portions.

21 Claims, 7 Drawing Sheets

HANGER CHAIN ANTI-SWAY DEVICE FOR GANTRY CRANE

FIELD OF THE INVENTION

This invention pertains to gantry cranes and more particularly to gantry cranes having a spreader that is suspended from hanger chains or cables.

BACKGROUND OF THE INVENTION

A gantry crane conventionally includes a vertically movable spreader (also referred to as a "grappler") that is used for lifting a container, trailer, or other load. More particularly, a gantry crane typically includes a plurality of vertical columns, and vertically-movable front and rear stabilizer beams. Each of the stabilizer beams is horizontally disposed between a respective pair of the columns. Additionally, the crane includes front and rear trolleys that are movably mounted to the respective stabilizer beams for movement in a lateral direction. The spreader is suspended from hanger chains supported by the laterally movable trolleys.

The spreader is required to be positioned a significant distance below the stabilizer beams in some applications, thus requiring the hanger chains to be relatively long. For example, such a configuration is required for placing a container on the ground next to a loaded double-stack rail container car or a container on a chassis. A problem is that the spreader tends to sway in a pendulum-like manner when subjected to horizontal acceleration or deceleration, and the sway magnitude increases with length of the hanger chains. Such acceleration and deceleration can be caused by the motion of the trolleys or driving the crane in forward or reverse directions as necessary to position the load. Spreader sway presents difficulties and inefficiencies for handling loads, particularly when long hanger chains are used. Therefore, a need exists for an improved spreader that resists swaying.

BRIEF SUMMARY OF THE INVENTION

The present invention provides a structure that dampens out sway of a spreader by absorbing kinetic energy in a lateral direction. For example, in an embodiment, a dampener is mounted to the resist motion of the hanger chain relative to the spreader, thereby retarding sway.

The dampener includes first and second portions that are movable relative to each other in a resistive fashion. The first portion is fixed to the spreader and the second end is fixed to the hanger chain at an attachment point located a vertical distance above a point at which the hanger chain is pivotally mounted to the spreader. The dampener is mounted so that a horizontal component of motion of the attachment point relative to the spreader (as occurs during sway) linearly displaces the first and second portions. According to a specific example, the dampener is a piston-cylinder structure including a cylinder and at least one piston or rod, wherein sway motion of the hanger chain causes the rod to correspondingly move into or out of the cylinder.

In an embodiment, the dampener has a double-rod hydraulic cylinder configuration, wherein the dampener includes a single cylinder with a piston and rods with opposed ends that extend in opposite directions from the cylinder. When one of the rods retracts in the cylinder, the rod correspondingly extends, and vice versa. In this embodiment, the cylinder is mounted to the spreader in a generally horizontal orientation. Preferably, the cylinder is mounted to the spreader at a floating joint that permits vertical movement of the cylinder with respect to the spreader while holding the cylinder to the spreader in a lateral direction. The floating joint may include a trunnion mounted to the spreader frame along a centerline of the spreader, wherein the trunnion has a vertical slots and the cylinder includes opposed pins that extend to fit within the respective vertical slots. Opposite ends of the double-acting rod are respectively mounted to the attachment points of the hanger chains on opposite sides of the spreader. In this manner, the double-acting, trunnion mounted cylinder dampens the sway motion of two of the hanger chains, causing the sway action to decay.

In another embodiment, the dampener may include at least one cylinder having a single rod. In this configuration, a first portion of the dampener (e.g., a base end of cylinder) is pivotally mounted to the spreader, and the opposite second portion (e.g., an end of the rod) is mounted to the attachment point of the hanger chain.

The dampener may be adapted to dissipate energy when the spreader sways in a lateral direction, i.e., side-to-side. Also, the dampener may be adapted to dissipate energy when the spreader sways in a drive direction, i.e., front-rear. In an embodiment, the gantry crane can be equipped with a plurality of dampeners respectively adapted to dissipate energy in both lateral and drive directions.

In order to direct sway force to the dampener, in an embodiment, the hanger chain includes an elongate bottom link that is pivotally mounted to the grappler. The bottom link is preferably unitary and rigid. The attachment point of the dampener rod to the hanger chain is at an upper portion of the elongate link, and a lower portion of the bottom link is pivotally mounted to the grappler, effectively creating a lever.

In an embodiment, an advantage of the present invention is that it provides a dampener that reduces spreader sway. A related advantage is that the dampener helps a gantry crane operator to position the spreader and its load with increased precision and efficiency. Moreover, the dampener advantageously helps avoid damage to containers and surrounding structures by reducing undesired sway motion.

In an embodiment, the dampener includes a hydraulic circuit with at least one pressure limiting valve arranged so that displacement of the first portion of the dampener relative to the second portion caused by sway of the spreader on the hanger chains results in fluid flow through the pressure limiting valve.

These and other advantages of the invention will be apparent from the description of the invention provided herein.

DETAILED DESCRIPTION OF THE INVENTION

Figure 1:
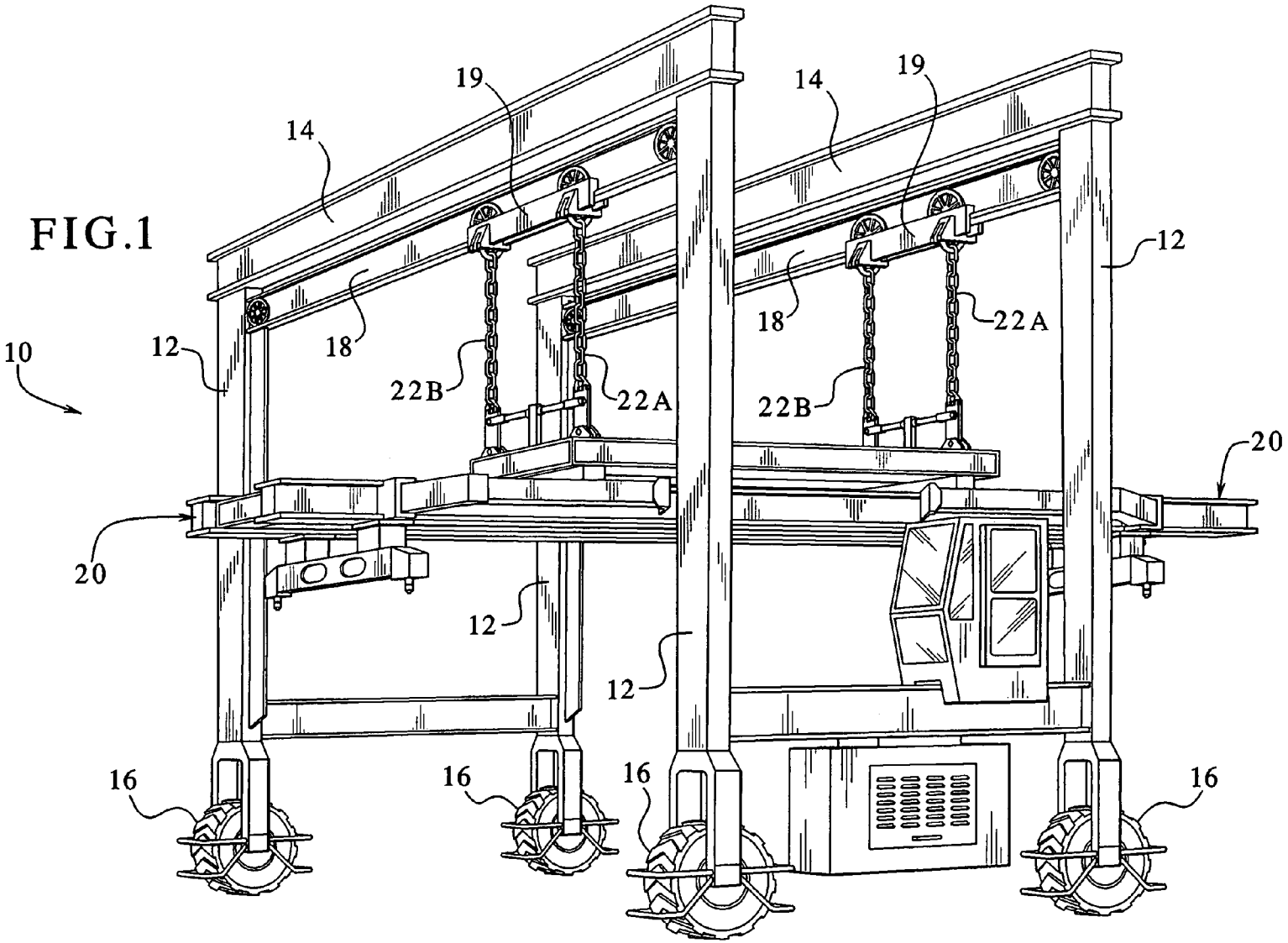
FIG. 1 is a perspective view of a gantry crane having features according to teachings of the present invention.
Figure 2:
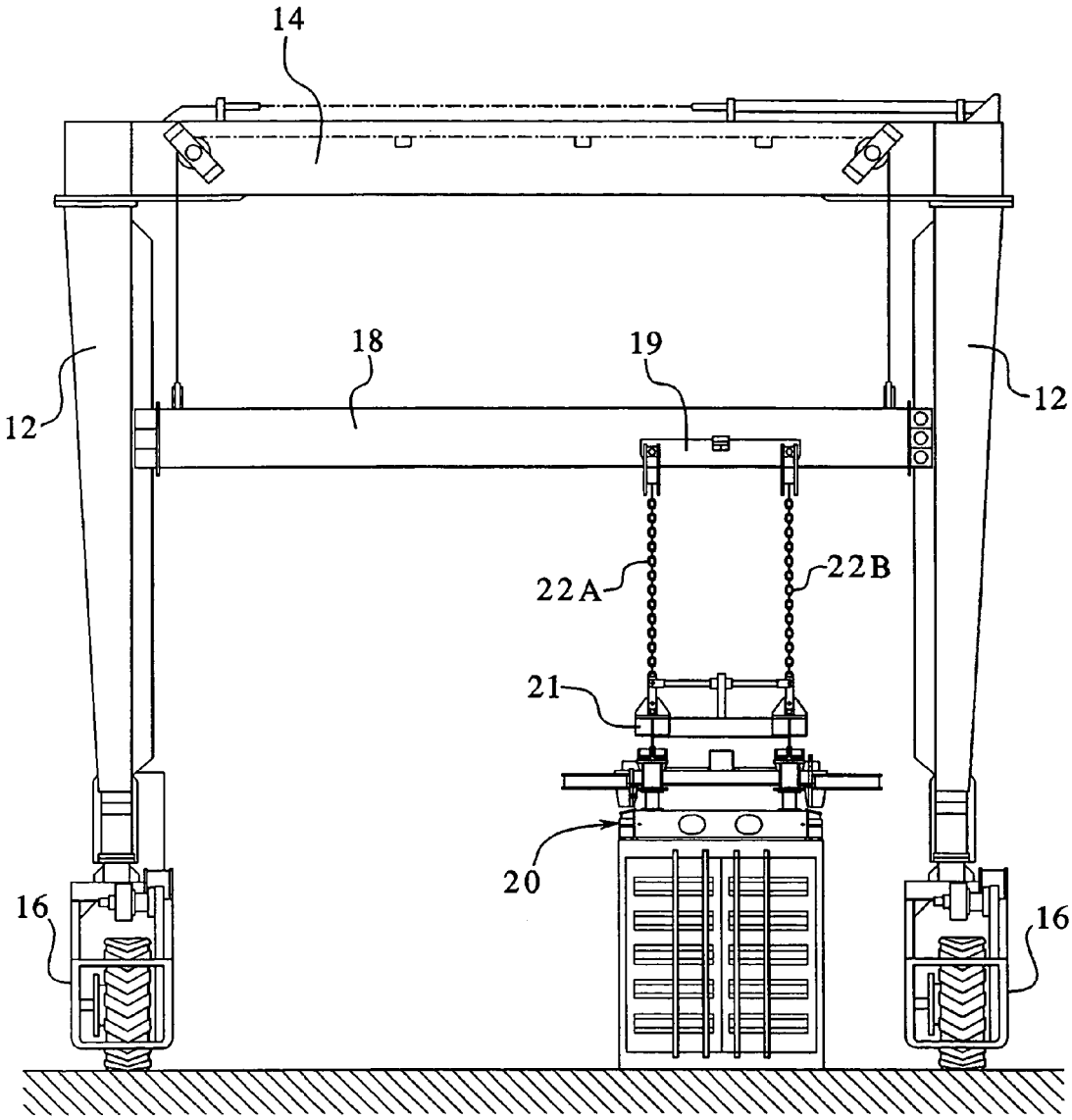
FIG. 2 is a rear elevation of the gantry crane of FIG. 1, the gantry crane including a spreader with long hanger chains grounding a container.

Referring to the Figures, wherein like numerals designate like components, an exemplary gantry crane 10 is illustrated FIGS. 1 and 2. Those skilled in the art will recognize that the present invention, although particularly useful for a grappler of a gantry cranes, will also be useful for canceling sway from suspended structures in various other applications. An exemplary embodiment of the invention shall be described herein with reference to its application to gantry cranes, but the scope of the invention shall not be so limited.

The illustrated embodiment of the gantry crane 10 includes four vertically upright columns 12 arranged in front and rear pairs. Upper support beams 14 are mounted to extend between upper ends of the respective front and rear pairs of the columns 12. The illustrated gantry crane 10 includes a plurality of wheel assemblies 16. The wheel assemblies are steerable and driven by motors.

To provide vertical lifting capability, the crane 10 includes a pair of vertically movable stabilizer beams 18. Each of the stabilizer beams 18 is adapted to move vertically up or down relative to columns 12 for lifting loads. Each of the stabilizer beams 18 is disposed horizontally between a pair of the columns 12 and has a pair of oppositely directed ends, each of the ends spaced from an inner side of one of the columns 12. In the illustrated embodiment, each of the stabilizer beams 18 supports a respective trolley 19 adapted to horizontally traverse the length of the stabilizer beam in a lateral direction.

For gripping and carrying a load, the crane 10 includes a spreader 20 (also known as a "grappler") that is suspended from the trolleys 19 by hanger chains 22A, 22B. In the illustrated example, four hanger chains are provided, each of the hanger chains being mounted to corners of a main frame 21 of the spreader 20. The spreader 20 may be of any type suitable for lifting a load. For example, those of ordinary skill in the art will know that spreaders are available in various configurations for lifting trailers, shipping containers, or other loads. In various forms, the spreader may include twistlocks, spreader arms, or both. Those of ordinary skill in the art will also appreciate that the hanger chains 22A, 22B could be a linked type of chain, cables, wire ropes, or any flexible structure having tensile strength suitable for supporting the spreader and its load. As used herein, the term "hanger chain" encompasses all such structures.

According to a teaching of the invention, at least one dampener is provided for reducing sway of the spreader on the hanger chains. The dampener is adapted to resist motion of the hanger chain with respect to the spreader, thereby retarding sway. In an embodiment, the dampener is a hydraulic cylinder having linearly movable first and second portions mounted to the spreader frame and hanger chain, respectively. In one exemplary embodiment, the dampener is a double-rod hydraulic cylinder mounted on a trunnion mounted centrally on the spreader, wherein opposite ends of the rod are mounted to respective hanger chains at opposite sides of the spreader. In another example, a single-rod hydraulic cylinder is applied to an individual hanger chain.

Figure 3B:
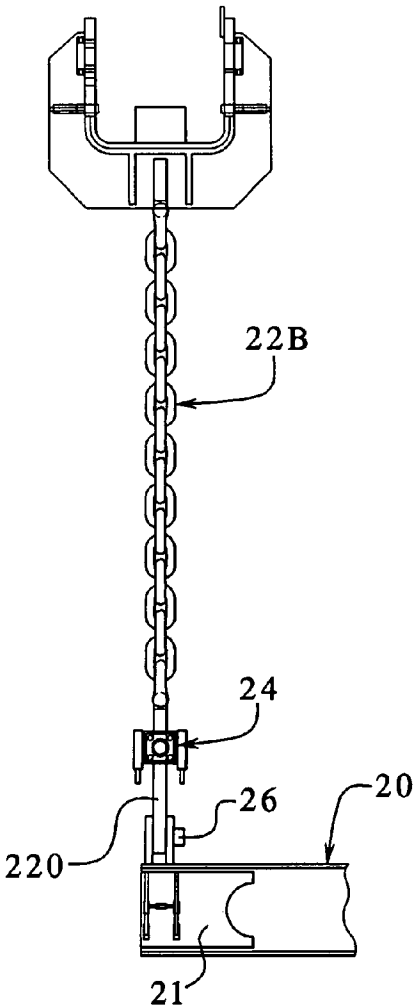
FIG. 3B is a fragmentary side view of the spreader of FIG. 3A.
Figure 3A:
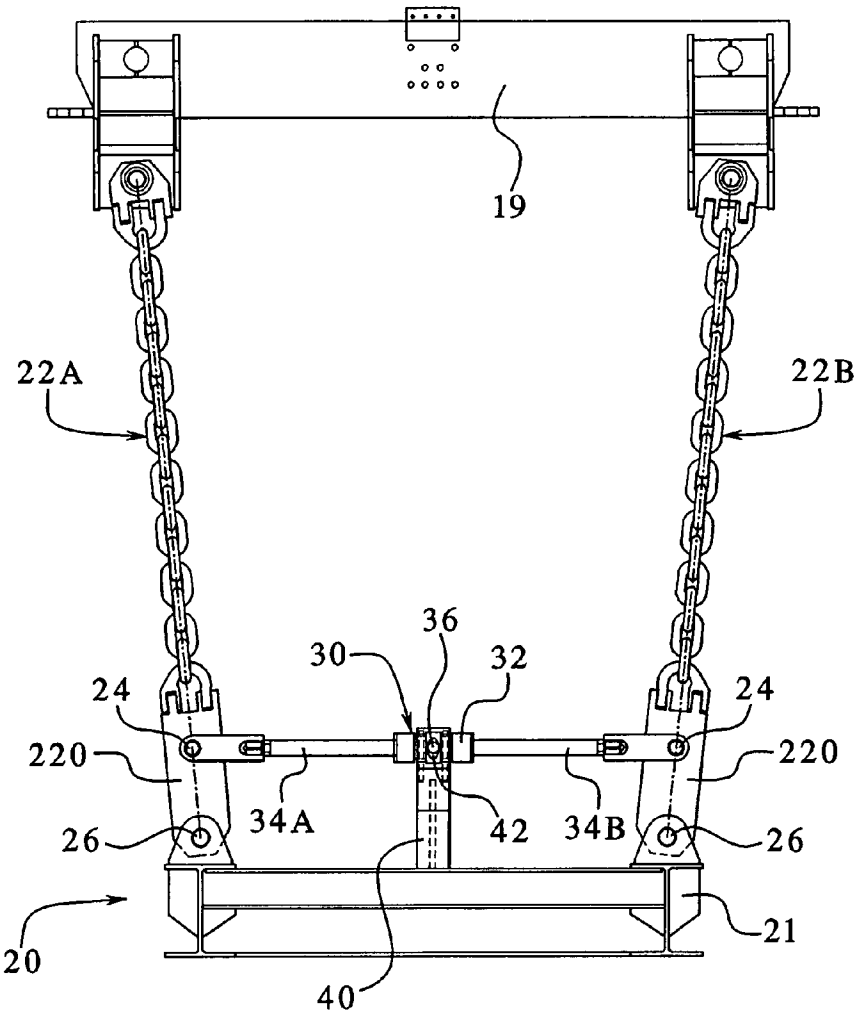
FIG. 3A is a fragmentary end view of the spreader of the crane of FIG. 1, the spreader suspended by hanger chains from the trolley and including a trunnion-mounted double-rod cylinder type of anti-sway dampener showing the hanger chains angles at steady state.

Referring to the embodiment illustrated in FIG. 3A, a dampener 30 includes a double-rod hydraulic cylinder 32 mounted to a center trunnion 40 of spreader 20. The dampener 30 includes dual rods 34A, 34B which extend from the cylinder 32 in respectively opposite directions. The trunnion 40 is preferably mounted to a main frame 21 of the spreader 20 at a centerline of the spreader. The trunnion 40 provides a floating joint that permits some vertical movement of the cylinder 32 with respect to the spreader 20 while holding the cylinder 32 to the spreader 20 in a lateral direction, and also permitting some relative pivotal motion. Accordingly, the trunnion 40 has at least one vertical slot 42, and the cylinder 32 includes at least one pin 36 that extends to fit within the vertical slots. Opposite ends of the rods 34A, 34B are mounted to respective attachment points 24 of the hanger chains 22A, 22B on opposite sides of the spreader. In this manner, the dampener 30 retards sway motion of two hanger chains 22A, 22B, causing the sway action to decay. The floating action provided by the trunnion 40 avoids subjecting the rods 34A, 34B to bending stress that could otherwise be caused by motion of the attachment points of the hanger chains with respect to the spreader 20.

The gantry crane 10 is preferably equipped with multiple dampeners 30. For example, where the spreader is suspended from front and rear pairs of hanger chains, a first one of the dual-acting dampeners 30 is provided to act on the forward pair of hanger chains, and a second one of the dual-acting dampeners 30 is provided to act on the rear pair of hanger chains.

In order to optimize the transmission of energy from the hanger chains 22A, 22B to the dampener 30, each of the illustrated hanger chains 22A, 22B includes a bottom link 220 which is rigid and generally elongate in shape. The bottom link 220 is pivotally mounted to the spreader at the pivot point 26, and an upper end of the bottom link opposite the pivot point 26 serves as the attachment point 24. The elongate shape of the bottom link 220 advantageously provides a rigid moment arm between the pivot point 26 and the attachment point 24.

Figure 4A:
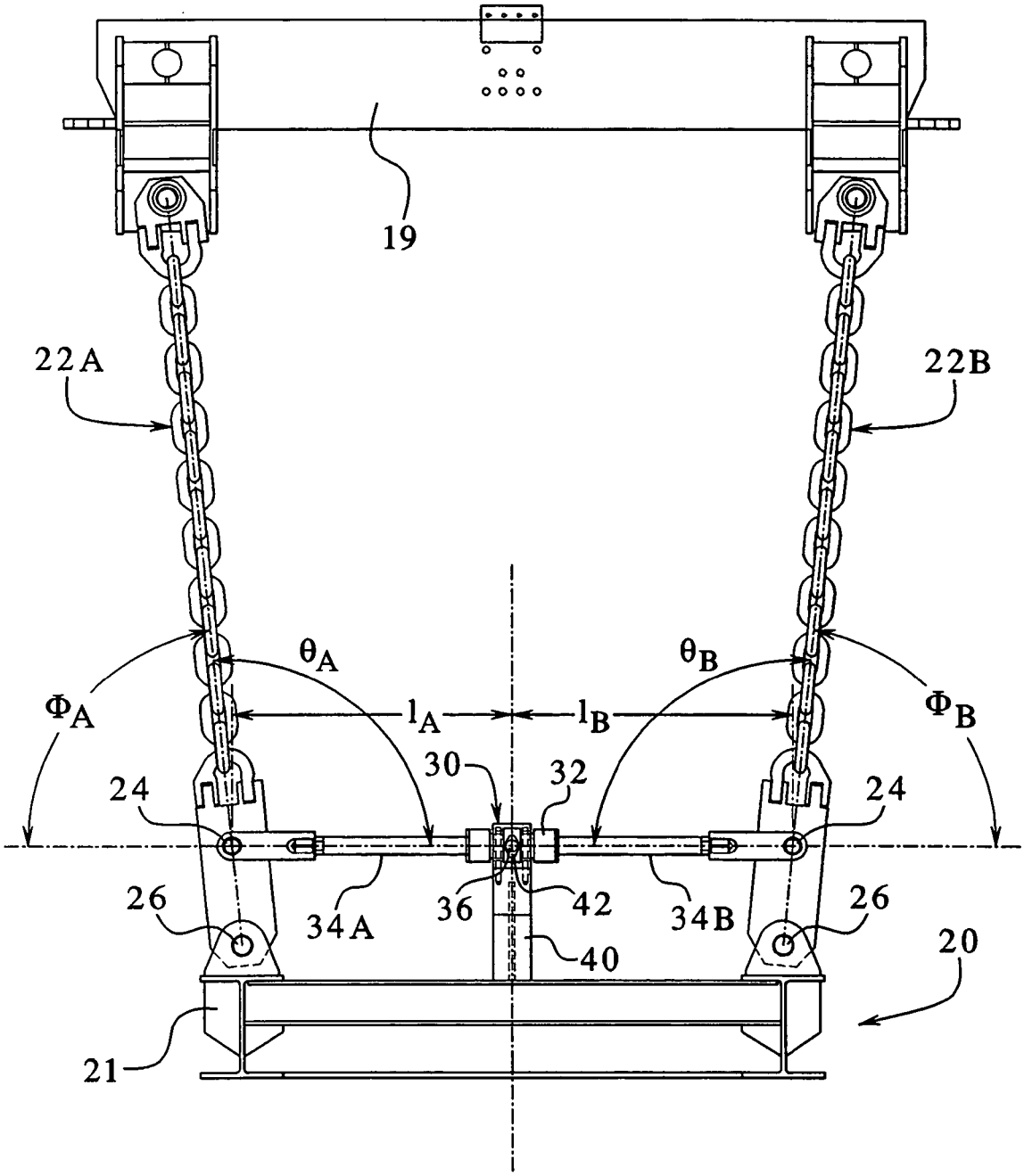
FIG. 4A is a schematic end view of the spreader and hanger chains in a steady state condition.
Figure 4B:
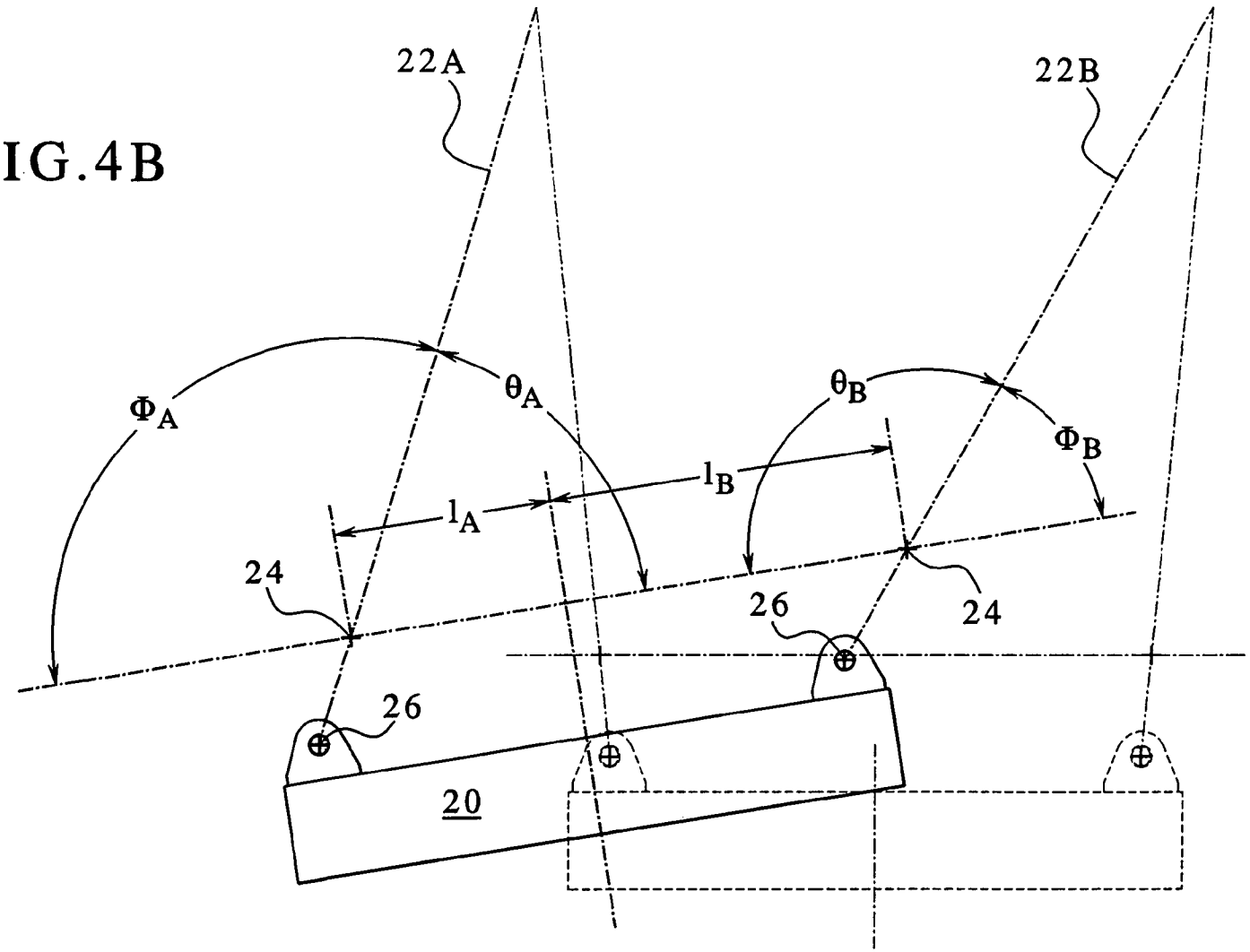
FIG. 4B is a fragmentary end view of the spreader and hanger chains in a swayed condition.

FIGS. 3A and 4A show the spreader at steady state, with no sway. The angles $\theta_A$ and $\theta_B$ in FIG. 4A indicate respective angles between the cylinder rods 34A, 34B and the first and second hanger chains 22A, 22B. As shown in FIG. 3A, when the spreader is at steady state, both hanger chains are at equal angles and the piston is centered in the hydraulic cylinder 32. FIG. 4B is a schematic view that shows an exemplary effect of sway on angles of the hanger chains and rod extension lengths.

Chain tension is a function of the total lifted load per chain ((payload weight+spreader weight)/number # of hanger chains) and hanger chain angle. In the following calculation, angle $\Phi_X$ is 180° minus an angle between the respective hanger chain and the respective rod. For example with reference to FIG. 3A, $\Phi_B$ is 180° minus an angle $\theta_B$ between the second hanger chain 22B and the respective rod 34B. Tension T of the hanger chain is calculated as follows:

$$T = \frac{WB}{\mathrm{SIN}\Phi_X} \quad \text{Where } T = \text{Hanger Chain Tension}, \; W = \text{Total Lifted Load (Per Chain)}$$

Also, at steady state conditions, a net force along the cylinder axis is 0 and the piston is centered in the cylinder body. For simplicity, and for illustrative purposes herein, it is assumed that the basic hanger chain tension does not vary significantly for a given lifted load during typical amounts of sway motion. With this assumption, the net force ($F_{Cyl}$) acting along the cylinder center line is:

$$F_{cyl}=T(\text{Cos } \Phi_A+\text{Cos } \Phi_B)$$

A change in the angle $\theta_{A,B}$ of the respective hanger chain 22A, 22B will move the corresponding rod 34A, 34B, as illustrated in FIG. 4B. Since the cylinder 32 is trunnion-mounted on a centerline of the spreader 20, fluid will be displaced from the end of the cylinder from which the rod is pulled out. In the condition illustrated in FIG. 4B, the rod 34B would be pulled to an extended position ($1_B>1_A$), thereby displacing fluid away from the corresponding end of the cylinder 32. Of course, a like volume of fluid must enter the opposite end of the cylinder to accommodate the retraction of the rod 34A.

Figure 5:
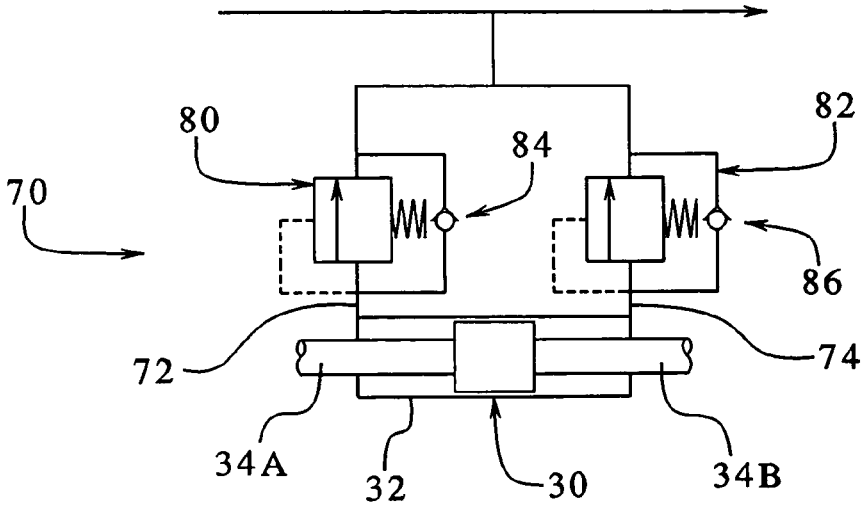
FIG. 5 is a schematic diagram of a hydraulic circuit for an anti-sway dampener having a double-rod cylinder.

To accommodate fluid flow for the double acting cylinder 32, a hydraulic circuit 70 is provided, as illustrated in FIG. 5. The hydraulic circuit 70 includes a first conduit 72 in communication with the cylinder at the side of rod 34A and a second conduit 74 in communication with the cylinder at the side of rod 34B. The hydraulic circuit 70 preferably creates a desired flow resistance. For example, in the embodiment shown in FIG. 5, the hydraulic circuit 70 includes first and second pressure limiting valves 80, 82 in communication with the respective ends of the cylinder 32. The first pressure limiting valve 80 is configured to restrict flow in the first conduit 72 away from the cylinder when rod 34A extends, and check valve 84 freely permits flow toward the associated end of cylinder 32 when the rod 34A is retracted. Similarly, the second pressure limiting valve 82 is configured to restrict flow in the second conduit 74 away from the cylinder when rod 34B extends, and check valve 86 freely permits flow toward the associate end of cylinder 32 when the rod 34B is retracted. Each of the pressure limiting valves 80, 82 is set at a pressure limit. In an embodiment, the pressure limit is fixed at a selected predetermined pressure, and alternatively the pressure limit is adjustable. The pressure is set at a level equivalent to the net force expected for a particular application, considering factors such as the predicted average container weight.

In an embodiment wherein fluid flow out of the cylinder 32 is resisted by a pressure limiting valves 80, 82, two conditions are possible. First, if a net force on the rod 34A, 34B creates a pressure that is less than a limit of the valve, the rod 34A, 34B cannot be displaced, thus resisting a tendency of the grappler to sway. Secondly, if a net force on the rod 34A, 34B creates a pressure greater than the setting of the pressure control valve 80 or 82, the rod will be displaced at a rate permitted by fluid flow up to the pressure limit of the pressure control valve. In such a situation, work done by the rod displacing the pressurized fluid absorbs a significant portion of the kinetic energy of the swaying mass. This advantageously results in a rapid damping of sway. The events previously described occur in both directions of sway motion, effectively retarding and damping lateral grappler motion. Also, the system described in the preceding discussion is installed at each dampener that, as mentioned, are preferably installed at both the front and rear spreader support points.

Figure 7:
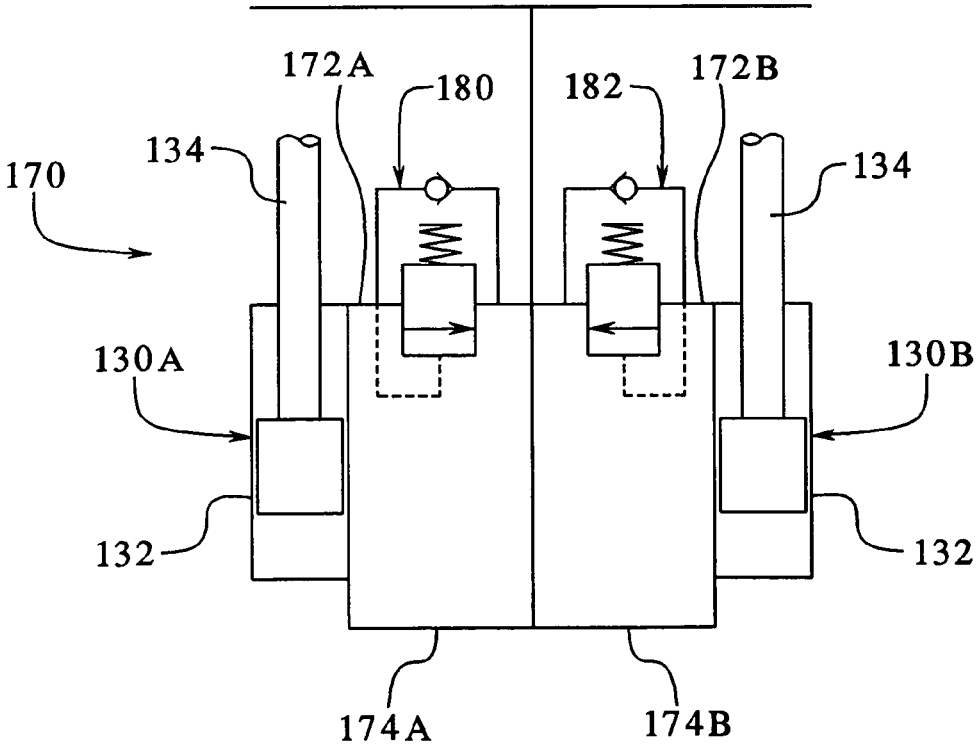
FIG. 7 is a schematic diagram of a hydraulic circuit for an anti-sway dampener having a pair of single-rod cylinders.
Figure 6:
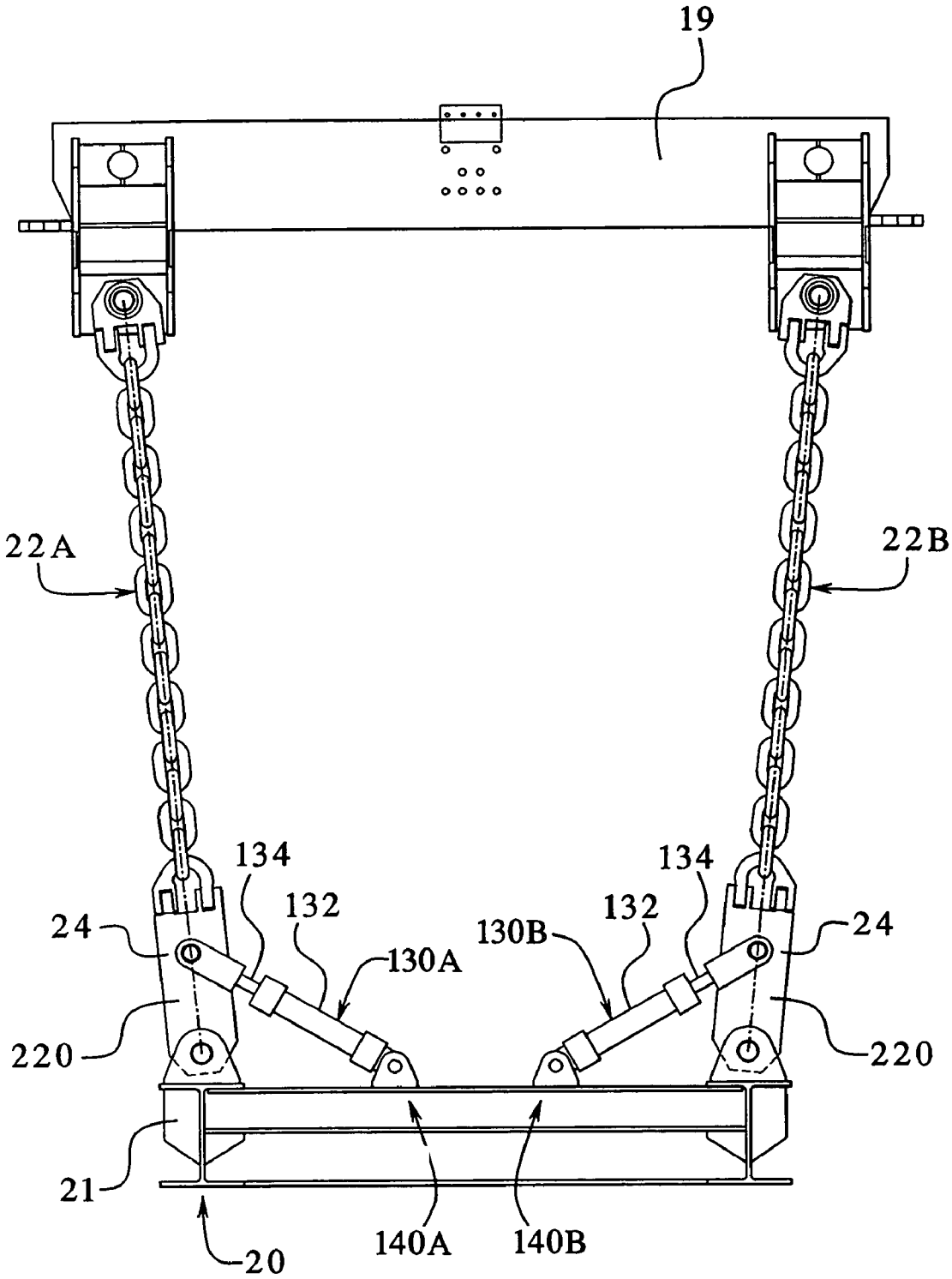
FIG. 6 is a fragmentary end view of a spreader and hanger chains with an alternative anti-sway dampener system including an individual single-rod cylinders applied to respective hanger chains.

In an alternate configuration, an anti-sway device is provided that includes a plurality of dampeners 130A, 130B each including a single-acting cylinder 132 with a single piston rod 134, as illustrated for example in FIG. 6. Preferably, first and second dampeners 130A, 130B are provided at both the front and rear of the grappler respectively in association with the individual hanger chains 22A, 22B. For each dampener 130A, 130B, the cylinder 132 has a base end 140 that is pivotably mounted to the main frame 21 of the spreader 20. Opposite the base end 140, the rod 134 is pivotably mounted to the attachment point 24 of the respective hanger chain 22A, 22B at a centerline of the hanger chain. Each of the dampeners 130A, 130B is positioned so that at a steady state condition, the piston rod 134 is at a mid-stroke position. FIG. 7 illustrates an exemplary hydraulic circuit 170 suitable to handle fluid flow to the dampeners 130A, 130B. The circuit 170 includes first and second conduits 172A, 174A in communication with the respective opposite sides of cylinders 132 of dampener 130, and first and second conduits 172B, 174B in communication with opposite sides of cylinder 132 of dampener 130B. The conduits 172A, 172B direct flow through first and second pressure limiting valves 180, 182 that are adapted to provide flow control as fluid flows from the respective dampeners 130A, 130B. Fluid from the base end of the cylinders is connected to a main spreader return line through conduits 174A, 174B.

The operation of the system of FIGS. 6 and 7 is generally similar to that described in connection with FIGS. 3–5, as will be recognized by those of ordinary skill in the art. A change of angle of the hanger chain 22A, 22B creates a force that tends to extend the rod 134 of at least one of the dampeners 130A, 130B. A set pressure limit of the pressure limiting valve resists the extending motion of the corresponding piston. The piston will extend if the sway force is greater than the pressure force, and the work done by the piston extending at the pressure setting of the pressure control valve dissipates the kinetic energy of the sway, thereby retarding motion.

Using the same principles, hydraulic cylinders can be mounted to resist sway in the drive direction also. Or, the cylinders could be mounted at an angle to the planes of trolley motion and the drive motion in order to resist sway in both of these directions.

Alternative dampener structures are possible. For example, a rotational dampener could be utilized wherein the dampener includes a lever having a distal end mounted to the hanger chain.

All references, including publications, patent applications, and patents, cited herein are hereby incorporated by reference to the same extent as if each reference were individually and specifically indicated to be incorporated by reference and were set forth in its entirety herein.

What is claimed is:

1. A gantry crane comprising:

at least one beam;

a spreader;

at least one hanger chain suspending the spreader from the beam, the hanger chain being mounted to the spreader at a pivot point;

a passive hydraulic sway dampener including a first portion and a second portion that are relatively movable in a dampened manner, wherein the first portion is mounted to the spreader, and wherein the second portion is mounted to the hanger chain at an attachment point that is vertically spaced above the pivot point so that motion of the attachment point relative to the spreader causes the first portion to move relative to the second portion.

2. The gantry crane of claim 1, wherein the hanger chain includes an elongate bottom link pivotally mounted to the spreader at the pivot point, the attachment point formed at an end of the elongate link opposite the pivot point.

3. The gantry crane of claim 1, wherein the first portion is a cylinder and wherein the second portion is rod that is telescopically movable within the cylinder.

4. The gantry crane of claim 1, wherein the first portion is pivotally mounted to the spreader.

5. The gantry crane of claim 1, wherein the second portion is pivotally mounted to the hanger chain.

6. The gantry crane of claim 1, wherein the passive hydraulic sway dampener is a double-rod cylinder, and wherein the first portion is a cylinder and the second portion includes double rods with opposed ends that project from respectively opposite ends of the cylinder, the opposed rod ends being mounted to respective hanger chains.

7. The gantry crane of claim 6, further comprising a floating mount to secure the cylinder to the spreader in a manner that permits the cylinder to move vertically relative to the spreader.

8. The gantry crane of claim 7, wherein the floating mount comprises:

a trunnion mounted to the spreader, the trunnion including at least one vertical slot; and a pin extending from the cylinder, the pin disposed in the vertical slot.

9. The gantry crane of claim 1, wherein the passive hydraulic sway dampener is mounted in an orientation for dissipating energy when the spreader sways in a lateral direction of the crane.

10. The gantry crane of claim 1, wherein the passive hydraulic sway dampener is mounted in an orientation for dissipating energy when the spreader sways in a drive direction of the crane.

11. The gantry crane of claim 1, wherein the first and second portions of the passive hydraulic sway dampener are linearly movable with respect to each other.

12. The gantry crane of claim 1, further comprising trolleys movably mounted to the beam, wherein the hanger chain has an upper end that is mounted to the trolley.

13. A spreader for a gantry crane comprising:

a spreader frame;

a plurality of hanger chains, each hanger chain of the plurality of hanger chains being mounted to the spreader frame to suspend the spreader frame; and at least one passive hydraulic sway dampener, the at least one passive hydraulic dampener being mounted to at least one hanger chain of the plurality of hanger chains and to the spreader frame, the at least one passive hydraulic sway dampener being operable to dampen sway motion of the spreader relative to a frame structure of the gantry crane.

14. The spreader of claim 13, wherein the at least one hanger chain is mounted to the spreader at a pivot point, and wherein the at least one passive hydraulic sway dampener includes a first portion and a second portion that are relatively movable in a dampened manner, wherein the first portion is mounted to the spreader, and wherein the second portion is mounted to the at least one hanger chain at an attachment point that is vertically spaced above the pivot point so that motion of the attachment point relative to the spreader causes the first portion to move relative to the second portion.

15. The spreader of claim 14, wherein the first and second portions of the at least one passive hydraulic sway dampener are linearly movable with respect to each other.

16. The spreader of claim 14, wherein the at least one hanger chain includes an elongate bottom link pivotally mounted to the spreader frame at the pivot point, the attachment point formed at an end of the elongate link opposite the pivot point.

17. The spreader of claim 14, wherein the first portion is a cylinder and wherein the second portion is a rod that is telescopically movable within the cylinder.

18. The spreader of claim 14, wherein the first portion is pivotally mounted to the spreader frame.

19. The spreader of claim 14, wherein the second portion is pivotally mounted to the at least one hanger chain.

20. The spreader of claim 14, wherein the passive hydraulic sway dampener is a hydraulic actuator, and wherein the first portion is a cylinder and the second portion includes a rod with an opposed end that projects from the cylinder, the rod end being mounted to a respective hanger chain.

21. The spreader of claim 14, wherein the passive hydraulic sway dampener includes a hydraulic circuit with at least one pressure limiting valve arranged so that displacement of the first portion relative to the second portion results in fluid flow through the pressure limiting valve.

* * * * *